US005077922A

United States Patent [19]

Miller

[11] Patent Number: 5,077,922

[45] Date of Patent: Jan. 7, 1992

[54] ENDLESS LOOP TRANSPORT SYSTEM AND DISPLAY DEVICE

[76] Inventor: Elmo E. Miller, 8201 16th St., Apt. 1126, Silver Spring, Md. 20910

[21] Appl. No.: 386,976

[22] Filed: Jul. 31, 1989

[51] Int. Cl.[5] ..... G09F 11/12

[52] U.S. Cl. ..... 40/472; 40/415; 474/198

[58] Field of Search ..... 40/472, 617, 470, 466, 40/415; 108/47; 248/544; 474/191; 110/415; 24/546, 551, 552, 553, 230.5, 237

[56] References Cited

U.S. PATENT DOCUMENTS

| | | | |
|---|---|---|---|
| 328,158 | 10/1885 | Wardwell | 474/191 |
| D. 507,633 | 6/1939 | Zimmermann | 40/415 |
| 581,250 | 4/1897 | McCawley | 24/237 |
| 685,771 | 9/1901 | Langer | 40/470 |
| 889,390 | 6/1908 | McOsker . | |
| 1,232,189 | 7/1917 | Bernstein | 40/617 |
| 1,371,076 | 3/1921 | Dicken . | |
| 1,374,282 | 4/1921 | Craig | 40/472 |
| 1,632,261 | 6/1927 | Woodrow | 248/544 |
| 1,979,776 | 11/1934 | Stephenson | 474/113 |
| 1,993,545 | 9/1935 | Gentry et al. . | |
| 2,181,878 | 12/1939 | Eckleberry | 474/198 |
| 2,267,861 | 12/1941 | Haley | 108/47 |
| 2,687,336 | 8/1954 | Smith et al. | 108/47 |
| 2,787,088 | 4/1957 | Gridley | 40/415 |
| 2,856,077 | 10/1958 | Stanton, Jr. | 40/617 |
| 3,633,296 | 1/1972 | Brenner | 40/466 |
| 3,735,513 | 5/1973 | Constant, Jr. et al. . | |
| 3,849,919 | 9/1974 | Gravelle et al. . | |
| 3,858,339 | 1/1975 | Short . | |

FOREIGN PATENT DOCUMENTS

| | | | |
|---|---|---|---|
| 383630 | 6/1922 | Fed. Rep. of Germany | 474/198 |

*Primary Examiner*—Kenneth J. Dorner
*Assistant Examiner*—James M. Gardner
*Attorney, Agent, or Firm*—Sughrue, Mion, Zinn Macpeak & Seas

[57] ABSTRACT

An endless loop transport system including objects suspended from an endless loop which is installed on a series of idler pulleys and a motor driven pulley which propels the loop and the suspended objects. The idler pulleys each includes a bracket which extends in a plane which is substantially perpendicular to the vertical axis about which the idler pulley rotates. The pulleys are free to tilt to compensate for changes in the loop.

14 Claims, 3 Drawing Sheets

FIG. 3
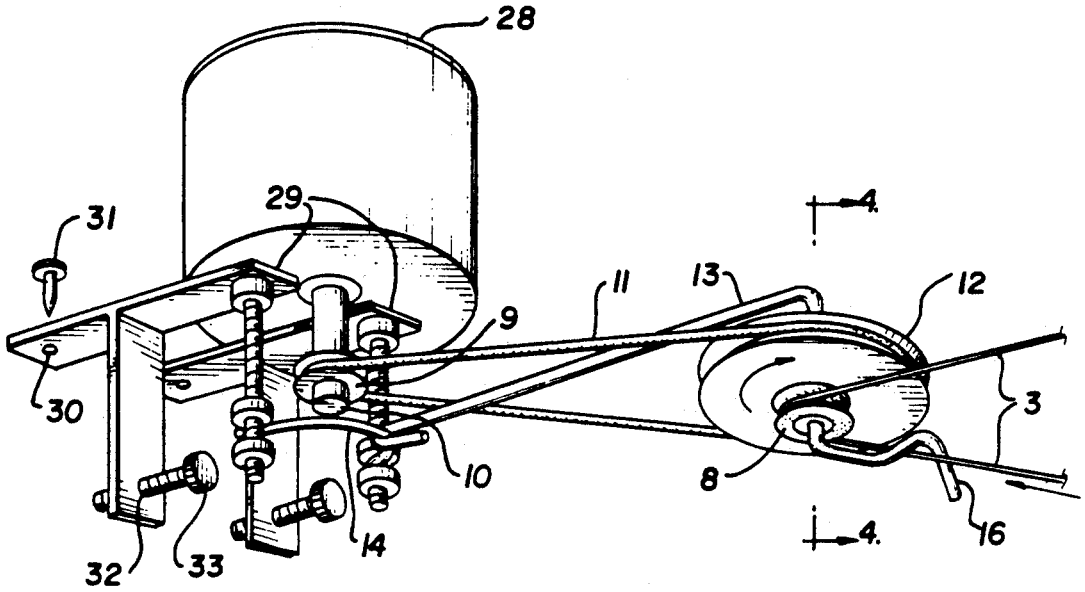
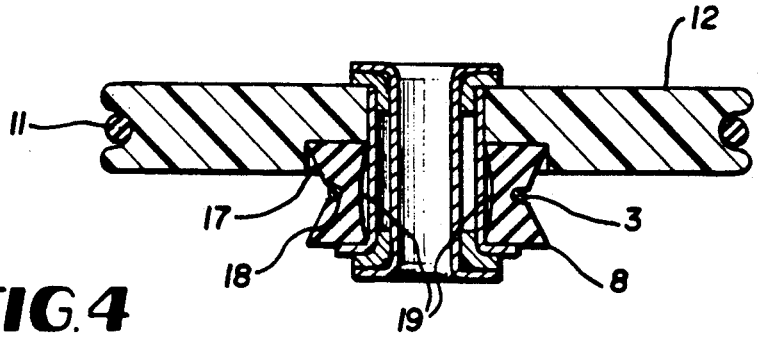
FIG. 4

ENDLESS LOOP TRANSPORT SYSTEM AND DISPLAY DEVICE

BACKGROUND OF THE INVENTION

This invention relates to animated decorations for the home, to toys, and to advertising displays, and more particularly to an improved system for moving objects of interest around a circuitous path, suspended on lines that are virtually invisible.

In the fields of advertising, toys, and seasonal decorations, the appeal of dynamic displays is widely recognized. That appeal is enhanced if the objects appear to fly through the air with no visible means of support, especially if popular mythology attributes magical flight to those objects, as it does, for example, to Santa and his reindeer.

Several patents have been issued for dynamic displays that involve similar basic elements: an endless loop revolving on a series of horizontal pulleys or sprockets, one of which is driven by a motor, and objects of interest suspended from that loop. Such systems have an inherent problem: the weight of each suspended object pulls down on the loop at its point of attachment, so it tends to pull the loop off a pulley or sprocket at that point. Therefore, previous inventions have required substantial material for the loop, such as chain, cable, or belt. Some examples are: U.S. Pat. No. 3,849,919 (Gravelle et al) and U.S. Pat. No. 3,735,513 (Constant, Jr. et al), which involve cable; U.S. Pat. No. 89,390 (McOsker), which involves chain; and U.S. Pat. No. 3,858,339 (Short) and U.S. Pat. No. 1,993,545 (Gentry et al), which involve different forms of endless belt. The present invention better solves the problem with pulleys that compensate dynamically for changes in the loop, and it uses a loop of ordinary line, such as fishline, which is much less expensive, virtually invisible, and allows much longer circuits of movement. The pulley system can be installed easily with a series of tacks on the top or side edges of door frames or window frames, so no unsightly holes are left after the system is put away, which is an advantage especially in home decorations and toys.

Endless loop transport systems are also used for moving heavy objects and people, as in ski lifts or mountain cable cars, but these systems involve a somewhat different principle: in all critical areas the endless loop rides on top of vertically mounted pulleys, and each of the objects is suspended by means of a rigid member that has a hook at its top end where it attaches to the loop. The attachment rides over the supporting pulley, so the object does not tend to pull the loop off the pulley. Horizontal pulleys are used only for reversing direction at either end of a run, and there arrangements must be made for otherwise supporting the weight of the object and for safety. Such systems are limited to transport along essentially straight courses.

SUMMARY OF THE INVENTION

This invention relates to a dynamic display in which objects of interest are suspended on lines that are attached to a revolving loop of line mounted on a series of horizontally oriented pulleys, one of which is driven by a motor. One object of the invention is to provide a simple, inexpensive means to prevent the loop's being pulled down off the pulleys by the weight of each object; therefore, the mounting bracket for each idler pulley is attached to a stationary object only by means of a guy line, so that it tilts and dips to compensate for changes in the loop. The driven pulley has a similar means of compensation; its mounting bracket is linked loosely to the motor so that it can tilt, and power is transmitted from the motor by means of a flexible drive belt and pulleys. The pulley driving the loop may be made of rubber for friction, and specially shaped to improve its grip.

Special tongs facilitate connecting and disconnecting suspended objects. The attachment for each idler pulley may incorporate a buckle for readily adjusting tension on the loop of line. These features enable one to install the loop on the pulleys and to adjust tension before attaching the objects of interest, which greatly simplifies installation and untangling any snarls that might develop.

Each of the pulleys for the loop incorporates an anti-fouling bar, which prevents suspending lines from getting wrapped around the axle when the objects make a sharp turn around a pulley at high speed. A special means of attaching idler pulleys to wall surfaces may be provided for those rare installations where it is required for the desired circuit.

DESCRIPTION OF THE DRAWINGS

FIG. 3 is a perspective view of the motor, its mount, transmission, and drive pulley;

FIG. 4 is a vertical sectional view along line 4—4 of the drive pulley shown in FIG. 3;

DETAILED DESCRIPTION

Figure 2:
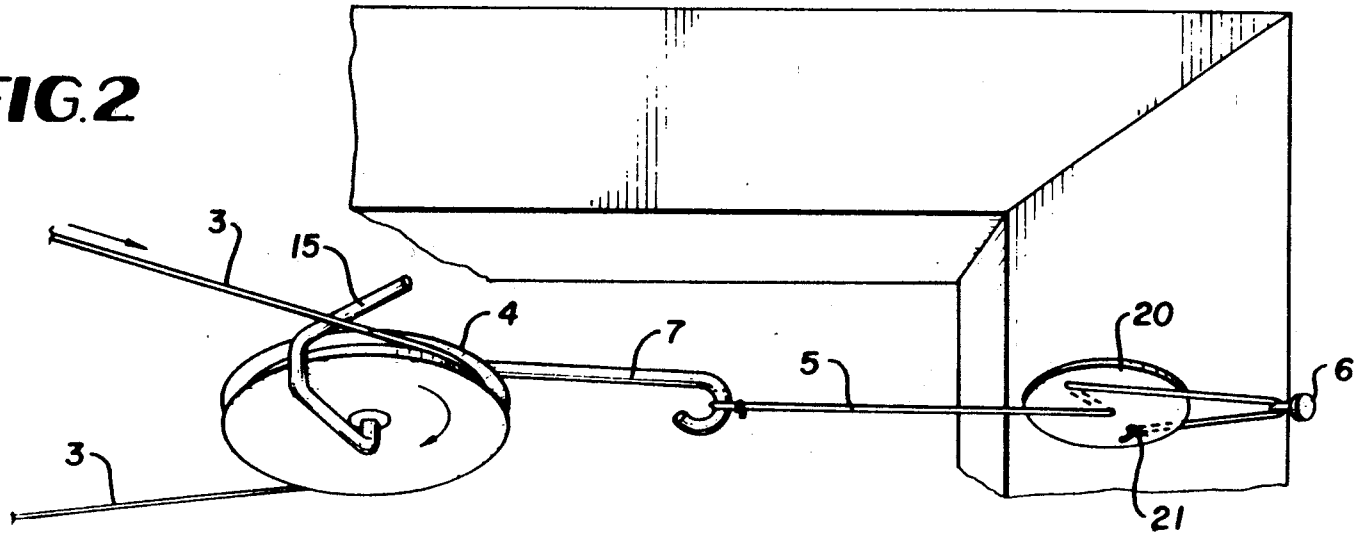
FIG. 2 is a perspective view of an idler pulley attached to a door frame molding.

Typical objects 1 (a Santa, sleigh and reindeer) are attached by means of suspending lines 2 to a segment of a revolving loop 3, which is mounted on a series of pulleys. FIG. 2 shows the loop 3 on an idler pulley 4, which is attached to a door frame by means of a guy line 5 and tack 6. The shape of the pulley bracket 6 is such that the guy line 5 lies in the plane defined by the adjacent segments of the loop 3. This arrangement positions the loop squarely on the pulley, and allows the pulley to tilt to compensate for any changes in attitude of the revolving loop.

The loop-driving pulley 8, FIG. 3, tilts like the idler pulleys to compensate for changes in the revolving loop. In the preferred embodiment, a pulley 9 on the motor shaft 10 drives a flexible belt 11 (e.g., an O-ring) to power an intermediate pulley 12 that is attached to the loop-driving pulley 8. (Alternatively, chain and sprockets could be used instead of the belt 11 and pulleys 8 and 12.) The loop-driving pulley 8 is mounted on a bracket with an extension, herein called a stabilizer bar 13, that is linked to another bar, herein called an anchoring bar 14 mounted on the motor frame. This arrangement compensates for changes in the revolving loop 3 like the guy line 5 does for each idler pulley 4: the linkage between stabilizer bar 13 and anchoring bar 14 is sufficiently loose to allow the loop-driving pulley 8 to tilt, and the proper distance between the loop-driving pulley 8 and motor shaft 10 is maintained because the rigid stabilizer bar 13 is linked to a circular segment of the anchoring bar 14.

Having described the basic features of the system, let us consider other features that solve certain problems or facilitate installation. Referring to FIG. 2, a bar 15, herein called an anti-fouling bar, prevents suspending lines from getting wrapped around the axle; it is a lateral extension of the pulley axle, bent up and over the incoming segment of the loop 3. Without this bar, at high speed around sharp corners a figure would occasionally be jerked up just as the harness pulled it across a corner, resulting in the suspending line going up and over the pulley, fouling the line and stopping movement. The anti-fouling bar 15 prevents such occurrences by guiding the suspending lines down and under the pulley. If the movement is reversible, anti-fouling bars may be provided over lines in both directions. In FIG. 3 an anti-fouling bar 16 on the loop-driving pulley 8 serves the same function as on the idler pulleys.

FIG. 4 shows how loop-driving pulley 8 shows how loop-driving pulley 8 provides traction in driving the endless loop. This pulley 8 which is made of rubber has a groove with sloping sides 17 that tend to center the line without having chunks cut out of the rubber. Within that groove there may be another groove 18 that is only a little wider than the diameter of the line of the loop so that it grips the line to prevent slippage, because tension on the loop 3 compresses the loop-driving pulley 8 inward, which causes the sides of that groove 18 to squeeze together. Its inner surface 19 may be concave to increase compression and the gripping effect. The relative diameters of the motor pulley 9, intermediate pulley 12, and loop-driving pulley 8 are selected to provide speed reduction without gears or other complex mechanism. For instance, pulleys of ½, 2⅛, and ⅜ inches diameter respectively have been used with a 1/16 inch thick O-ring and a 3300 rpm motor, to move the loop and suspended objects at a moderately fast speed of 134 feet/minute, with some stretching and slippage of the belt.

In order to adjust tension on the revolving loop, there is a buckle 20, FIG. 2 that provides for shortening the guy line 5 of at least one of the idler pulleys 4. The buckle 20 is a flat piece of plastic or metal with at least two holes in it. To make the adjustment, the pulley bracket 7 is pulled toward the tack 6 as the buckle 20 is slid along the guy line 5. This provides for shortening the guy line by almost half; if greater shortening is needed, more line can be pulled through the hole by the knot 21, another knot tied, and the excess line cut off. Around the holes the buckle may be funnel-shaped to facilitate threading the line through the holes. These adjustments facilitate installation because the knot to form the revolving loop can be tied when the loop is under minimal tension, without concern for the degree of tension on the loop.

Figure 1:
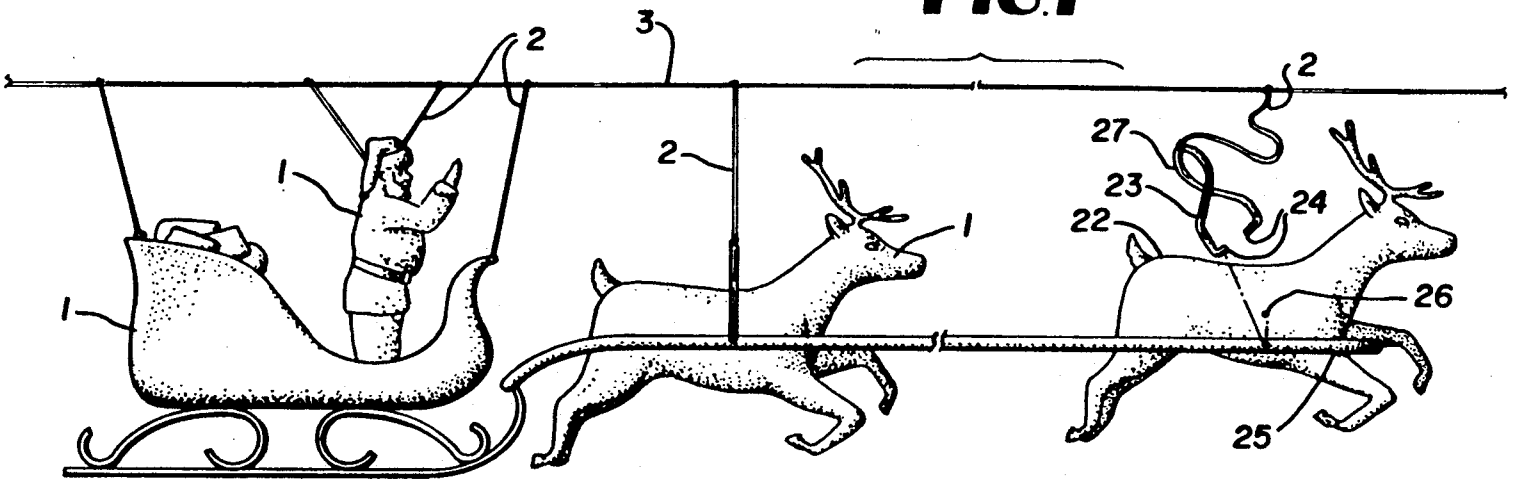
FIG. 1 is a side view of typical objects, a Santa, sleigh and reindeer, suspended from a revolving loop.

A handy means of attaching objects to the revolving loop is shown in FIG. 1. Each reindeer 22 is attached to a suspension line 2 by means of tongs 23, which are made of spring wire, and which have points 24 that go through the harness strap 25 and into holes 29 in the sides of the reindeer. A loop of wire in the tongs serves as a handle 30, which may be squeezed to open the points 24. Attachments for Santa and sleigh can be similarly disconnected for ease of assembly, disassembly and storage.

The motor 28, FIG. 3, is mounted on a pair of brackets 29 that may be attached to any handy door frame or window frame, and removed without leaving holes that would be visible from a normal viewpoint. Each bracket 29 has a hole 30 through which a nail or screw 31 secures it to the top of the frame, and a threaded hole 32 for a thumbscrew 33 to position the motor and adjust to the contour of any molding against which it rests. An electrical switch would be provided either in the power cord or in an extension cord so that movement can be controlled from a remote location. A variable speed motor and control might be used. Remote control via radio signals is another option for this invention.

Figure 5:
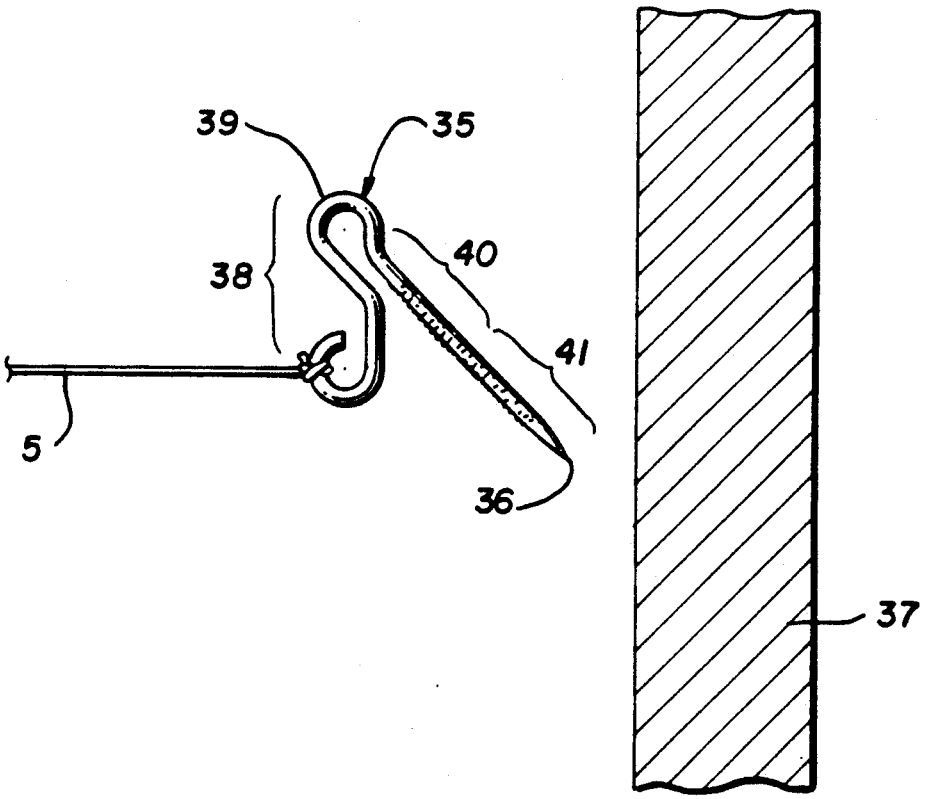
FIG. 5 is a side view of a wire anchor for attaching a guy line to a wall surface.

A wire anchor 35 (FIG. 5) may be used, when necessary, to attach guy lines to wall surfaces with minimal damage to the wall. To install the anchor, the point 36 is pressed into the wall surface 37 (usually dry wall), and the offset segment 38 is held parallel to the wall as the head 39 is driven into the wall with a hammer. As the guy line 5 tightens, the anchor does not tend to pull out of the wall because of the offset segment 38, which tends to bend to push the upper part of the shank 40 into the wall and transfer pulling force to the lower part of the shank 41, where the wall is thicker. The shank 40 and 41 has serrated surfaces to increase resistance to being pulled out of the wall, particularly if the pulling force is not parallel to the shank.

Another embodiment of this invention relates to display of messages, which involves suspending letters and numerals instead of model figures from the revolving loop. The letters and numerals might be attached to the loop by means of suspending lines, or mounted on a flexible material (e.g., mesh or ribbon) that is attached to the line either directly or with suspending lines. An advertising display might use both model figures and text attached to different segments of a revolving loop, to attract people's interest first and then to present a commercial message. Another embodiment relates to transport of parts for various treatments, such as painting.

I claim:

1. A system for moving objects on a circuitous path, comprising:

loop-driving pulley means comprising a first pulley having a first groove;

a plurality of idler pulleys each having a groove and each being rotatable about a vertical axis;

a motor with a rotatable shaft for driving said first pulley;

an endless loop of line disposed around the first groove and the grooves of said plurality of idler pulleys;

means for suspending the objects from said endless loop;

each of said idler pulleys having a bracket which extends in a plane which is substantially perpendicular to the vertical axis of the respective idler pulley;

a plurality of guy lines for said idler pulleys, respectively, each of said guy lines being attached at one end to one of said idler pulley brackets and being attached at the other end to a stationary object so that each of said idler pulleys compensates for changes in attitude of said endless loop;

an endless elongate flexible element, and wherein said loop-driving pulley means further comprises a second pulley, said first and second pulleys of said loop-driving pulley means are rotatable about a common axis, and wherein the elongate flexible element is disposed around said second pulley of said loop-driving pulley means and around said rotatable shaft; and a mounting bracket for said motor, and wherein said loop-driving pulley includes a mounting bracket which is pivotally connected to said motor mounting bracket so that said loop-driving pulley means compensates for changes in attitude of said endless loop.

2. The system as defined in claim 1, wherein said motor includes a motor drive pulley mounted on said rotatable shaft, and said elongate flexible element is disposed around said motor drive pulley and said second pulley of said loop-driving pulley means.

3. The system as defined in claim 1, wherein said first pulley has a smaller diameter than said second pulley.

4. The system as defined in claim 1, wherein said motor mounting bracket includes a semi-circular element, and wherein said mounting bracket of said loop-driving means is pivotally connected to said semi-circular element.

5. The system as defined in claim 1, wherein said elongate flexible element is an O-ring.

6. The system as defined in claim 1, wherein said object suspending means comprises spring wire tongs for firmly holding the objects when in a closed position and for releasing the objects when in an open position.

7. The system as defined in claim 6, wherein said spring wire tongs includes a loop of wire for opening and closing the tongs.

8. A system for moving objects on a circuitous path, comprising:

loop-driving pulley means comprising a first rubber pulley having a first substantially V-shaped groove;

a plurality of idler pulleys each having a groove and each being rotatable about a vertical axis;

a motor for driving said first pulley;

an endless loop of line disposed around the first groove and the grooves of said plurality of idler pulleys;

means for suspending the objects from said endless loop;

each of said idler pulleys having a bracket which extends in a plane which is substantially perpendicular to the vertical axis of the respective idler pulley;

a plurality of guy lines for said idler pulleys, respectively, each of said guy lines being attached at one end to one of said idler pulley brackets and being attached at the other end to a stationary object so that each of said idler pulleys compensates for changes in attitude of said endless loop; and another groove, within said V-shaped groove, said another groove having a width which is approximately equal to a thickness of the endless loop of line.

9. The system as defined in claim 8, wherein an inner diameter surface of said first pulley is transversely concave.

10. A system for moving objects on a circuitous path, comprising:

loop-driving pulley means comprising a first rubber pulley having a first substantially V-shaped groove;

a plurality of idler pulleys each having a groove and each being rotatable about a vertical axis;

a motor for driving said first pulley;

an endless loop of line disposed around the first groove and the grooves of said plurality of idler pulleys;

means for suspending the objects from said endless loop;

each of said idler pulleys having a bracket which extends in a plane which is substantially perpendicular to the vertical axis of the respective idler pulley;

a plurality of guy lines for said idler pulleys, respectively, each of said guy lines being attached at one end to one of said idler pulley brackets and being attached at the other end to a stationary object so that each of said idler pulleys compensates for change in attitude of said endless loop; and at least one buckle for one of said idler pulleys, said at least one buckle having a plurality of holes, and said guy lines being disposed through the plurality of holes of said buckles, respectively.

11. The system as defined in claim 10, wherein each of said idler pulley brackets includes an end portion which lies in substantially the same plane as the idler pulley groove and which provides a means for attachment of one of said guy lines.

12. The system as defined in claim 11, wherein said end portion is a hook.

13. A system for moving objects on a circuitous path, comprising:

loop-driving pulley means comprising a first pulley having a first groove;

plurality of idler pulleys each having a groove and each being rotatable about a vertical axis;

a motor for driving said first pulley;

an endless loop of line disposed around the first groove and the grooves of said plurality of ilder pulleys;

means for suspending the objects from said endless loop;

each of said idler pulleys having a bracket which extends in a plane which is substantially perpendicular to the vertical axis of the respective idler pulley; and a plurality of guy lines for said idler pulleys, respectively, each of said guy lines being attached at one end to one of said idler pulley brackets and being attached at the other end to a stationary object so that each of said idler pulleys compensates for changes in attitude of said endless loop wherein each of said idler pulley includes an anti-tangling bar which extends first below the idler pulley and then up and above the incoming endless loop, thereby preventing tangling of the object suspending means and objects with said endless loop.

14. A system for moving objects on a circuitous path, comprising:

loop-driving pulley means comprising a first pulley having a first groove;

a plurality of idler pulleys each having a groove and each being rotatable about a vertical axis;

a motor for driving said first pulley;

an endless loop of line disposed around the first groove and the grooves of said plurality of idler pulleys;

means for suspending the objects from said endless loop;

each of said idler pulleys having a bracket which extends in a plane which is substantially perpendicular to the vertical axis of the respective idler pulley; and a plurality of guy lines for said idler pulleys, respectively, each of said guy lines being attached at one end to one of said idler pulley brackets and being attached at the other end to a stationary object so that each of said idler pulleys compensates for changes in attitude of said endless loop wherein said loop-driving pulley means includes an anti-tangling bar which extends first below the loop-driving pulley and then up and above the incoming endless loop, thereby preventing tangling of said object suspending means and objects with said endless loop.

* * * * *